United States Patent [19]

Wexler

[11] Patent Number: 4,947,584

[45] Date of Patent: Aug. 14, 1990

[54] AUTOMATIC DOOR BOTTOM

[75] Inventor: Elias Wexler, Scarsdale, N.Y.

[73] Assignee: Zero International Inc., Bronx, N.Y.

[21] Appl. No.: 250,271

[22] Filed: Sep. 27, 1988

[51] Int. Cl.[5] ..... E06B 7/20

[52] U.S. Cl. ..... 49/307; 49/311; 49/478

[58] Field of Search ..... 49/307, 303, 306, 308, 49/309, 310, 478, 311

[56] References Cited

U.S. PATENT DOCUMENTS 3,703,788 11/1972 Rivers ..... 49/307

4,703,586 11/1987 Smith et al. ..... 49/307

*Primary Examiner*—Kenneth J. Dorner

*Assistant Examiner*—Gerald A. Anderson

*Attorney, Agent, or Firm*—Pasquale A. Razzano

[57] ABSTRACT

An automatic door bottom is disclosed in which a channel member has a drop bar assembly mounted therein with an adjustable length push rod connected to the drop bar for cooperation with a spring means to selectively lower and raise the drop bar in response to opening and closing the door. A pair of magnets are placed within the channel on the drop bar and in the channel for effecting movement of the drop bar to insure that the bar drops in a sizzle-like manner, with the end closest to the door hinge dropping down and lifting up, before the end away from the door hinge.

12 Claims, 2 Drawing Sheets

AUTOMATIC DOOR BOTTOM

BACKGROUND OF THE INVENTION

1. Field of the Invention

This invention relates to a seal or weatherstrip for a door and more particularly to a door bottom seal which is automatically actuated to seal the gap between a door bottom and its sill as the door is closed and automatically retracted when the door is opened.

2. Description of the Prior Art

Typically, door bottom seals or weatherstrips comprise a flexible sealing element held within a mounting means attached to the bottom of a door. The purpose of the weatherstrip is to block drafts, light, noise, and foreign objects from passing through the space normally provided between the bottom of the door and the door sill. However, these sealing means are subject to wear and deterioration due to the rubbing of the sealing element against the door sill and floor as the door is opened and closed. This is especially true if the sealing element is forced against the door sill to obtain a more effective seal. Moreover, if the floor near the door sill is covered with carpeting, the sealing element causes undue wear on the carpet and requires unnecessary effort to operate the door. Additionally in actual installation the floor and door bottom are not necessarily parallel and therefore a completely effective seal is not possible with a fixed element.

Different methods of overcoming the rubbing and wearing problems of these sealing means have been attempted, including the resilient supporting of the sealing element in the mounting element, and automatic door seals such as shown in U.S. Pat. No. 3,131,441 to G.W. Cornell for WEATHER STRIP, but they do not work as effectively as the present invention. The automatic door bottom of U.S. Pat. No. 3,703,788 overcame these problems and the following is an improvement over the device shown therein.

SUMMARY OF THE INVENTION

Briefly, the present invention is an automatic door bottom for sealing the gap between the bottom of a door and its adjacent sill when the door is closed. The door bottom comprises an inverted U-shaped channel which is internally divided into upper and lower sections and is mounted along the bottom of a door. A flexible sealing element is carried within the channel on a drop bar assembly. Means are provided for reciprocating the sealing element partially out of and back into the channel upon closing and opening the door respectively. The means for reciprocating the sealing element includes a pushrod actuated by bearing against the jamb of the door as the door is closed and spring means for retracting the sealing element when the door is opened. One or two pairs of interactive magnets are employed on the automatic door bottom to permit one end of the flexible sealing element to contact the door sill before the other. This is accomplished by placing one magnet of each pair in the upper internal section of the channel and the second magnet of each pair on the drop bar assembly. One pair of magnets repels each other while the second pair, if employed, attract each other. This has the effect of forcing the end of the drop bar assembly with the repelling pair of magnets out of the channel before the other end.

It is therefore an important object of the present invention to provide an improved automatic door bottom for sealing the gap between the bottom of the door and the sill.

Another object of the present invention is to provide a weatherstrip which can be mounted either on the surface of a door or within the bottom of the door and the sill.

A still further object of the present invention is to provide a door bottom which can be easily manufactured and assembled and easily adjusted during installation to fit a range of different widths of doors and sizes of gaps between the door and its sill.

Yet another object of the present invention is to provide an automatic door bottom which seals one end before the other to minimize closure problems and maximize sealing ability.

BRIEF DESCRIPTION OF THE DRAWINGS

The specific nature of the invention, as well as other objects, aspects, uses, and advantages thereof, will clearly appear accompanying drawings, in which.

DESCRIPTION OF THE PREFERRED EMBODIMENT

Figure 1:
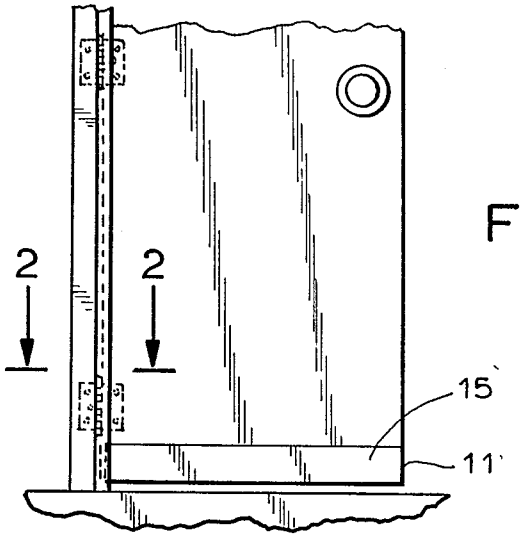
FIG. 1 is a side elevational showing the preferred embodiment of the present invention mounted on an open door.
Figure 7:
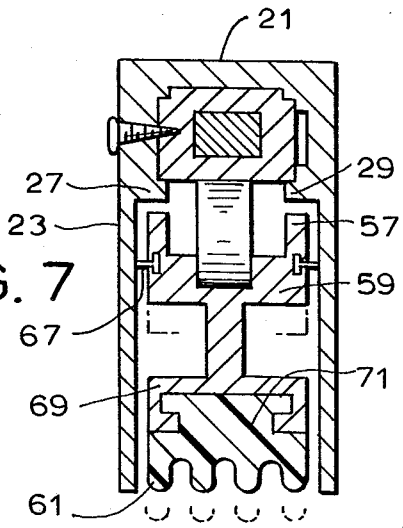
FIG. 7 is a side cross sectional view of the present invention taken along line 7—7 of FIG. 3.
Figure 6:
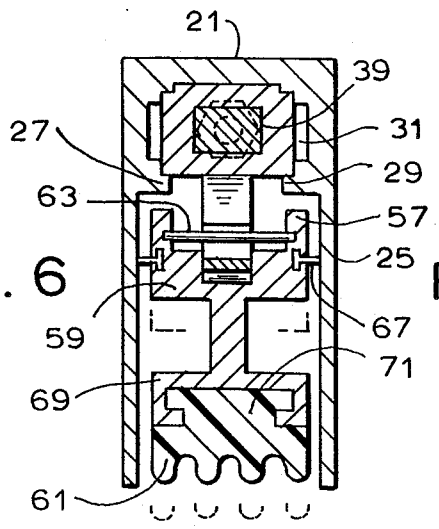
FIG. 6 is a side cross sectional view of the present invention taken line 6—6 of FIG. 3.

Referring now to the drawings, and initially to FIG. 1, the automatic door bottom 11 of the present invention includes an extruded metallic channel 13, preferably made of aluminum or aluminum alloy. As shown in FIGS. 5–7, the channel 13 is an inverted "U" shape for mounting along the bottom of a door. (See also FIGS. 1–2 and 4–5 of U.S. Pat. No. 3,703,788, the disclosure of which is incorporated herein by reference.) The upper surface 21 of the channel has a plurality of holes 17 formed therein to permit the channel to be screwed onto the bottom edge of a door. The channel 13 may take any other convenient shape dictated by the particular mounting arrangement such as shown, for example, in FIG. 6 of U.S. Pat. No. 3,703,788.

The channel is shown in FIGS. 5–7 as having an elongated, rectangular inverted U-shaped portion comprising a flat horizontal top 21 and two vertical legs 23 and 25. The interior surface of the leg portions 23 and 25 are provided with integral longitudinal rib members 27 and 29 extending toward the opposite leg. These rib members 27 and 29 are approximately one-third of the way from the top 21 and divide the interior of the channel 13 into upper and lower internal sections 31 and 33 connected by an opening between the ribs 27 and 29. The upper section 31 is disposed along the closed portion of the U-shaped channel, adjacent to the flat horizontal top 21, and the lower section 33 is disposed along the open portion of the channel 13. The ribs 27 and 29, as shown, are formed during the extruding of the channel 13, but may be made from separate elements and fixed to the legs 23 and 25 in any suitable manner.

Figure 4:
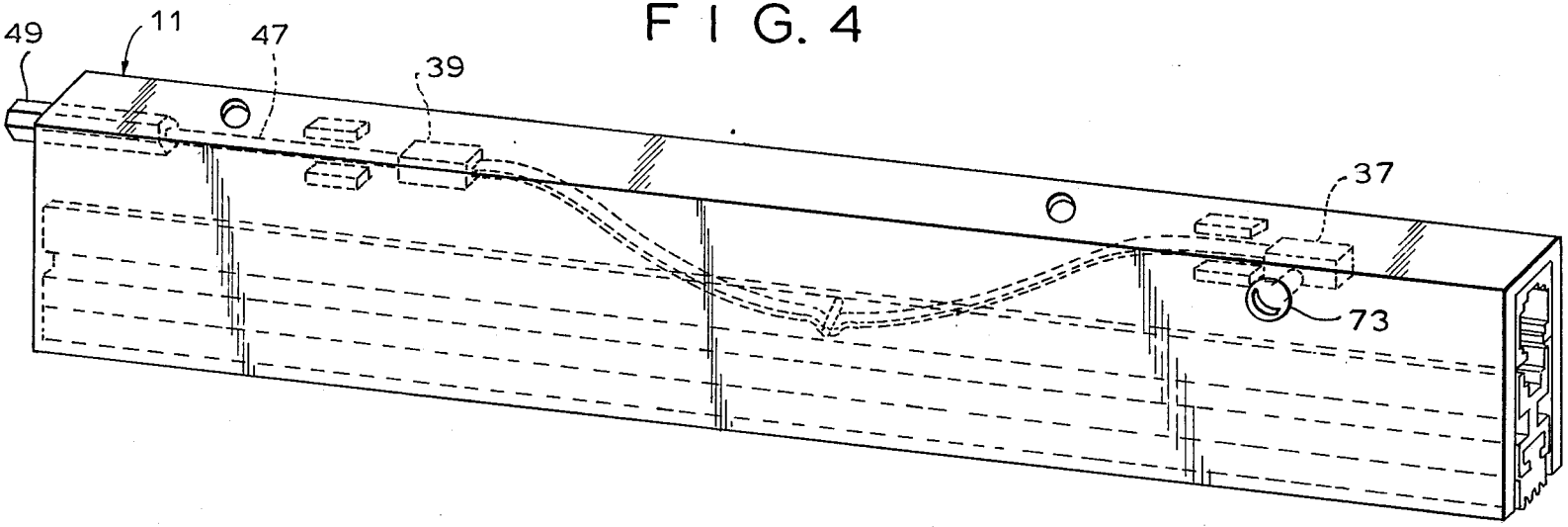
FIG. 4 a front perspective view of the present invention.
Figure 3:
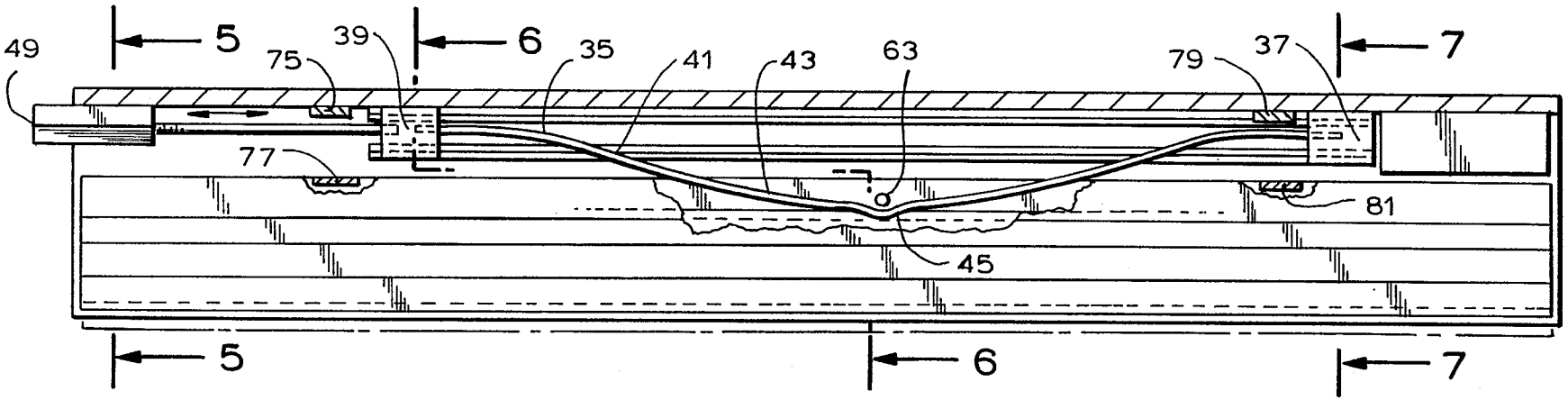
FIG. 3 is a front cross sectional view of the present invention.
Figure 5:
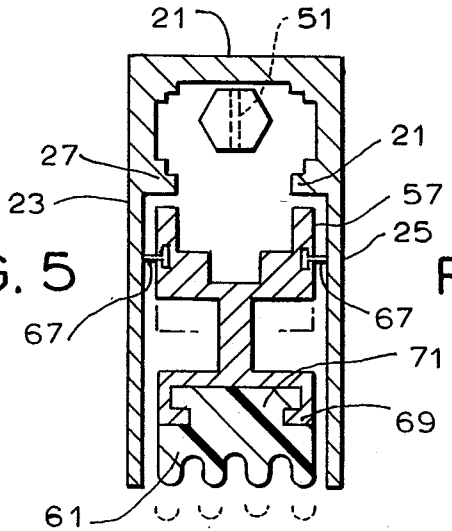
FIG. 5 is a side cross sectional view of the present invention taken line 5—5 of FIG. 3.

A pushrod and spring assembly 35, shown in detail in FIGS. 3 and 4 is slidably insertable into the upper section 31 of the channel 13.

The pushrod and spring assembly 35 includes a fixed block 37 and a slide block 39 which are formed to be disposed within the upper internal section 31 of the channel 13. In the preferred embodiment, they are rectangular blocks the first of which, 37, has a drilled and tapped hole formed therein whereby it can be removably secured in the channel 13 in a predetermined position (see FIG. 4), e.g. by a screw 73. The second block 39 is freely mounted within the upper internal section and is slidable with respect to the first block 37.

The two blocks 37 and 39 are connected by a curved leaf spring 41, preferably of spring steel, which is fixedly attached to the two slide blocks 37 and 39 in any convenient manner. The leaf spring 41 is concave or dish-shaped and has its central portion 43 extending into the lower section 33 of the channel 13. The spring 41 has a dimpled or depressed portion 45 formed on the concave side thereof, approximately midway between the blocks 37 and 39 for locating a pivot pin 63.

A pushrod 47 is connected to the slidable second block 39 and projects away from the spring member 41 and out of the end of the channel 13. The rod 47 has screw threads formed on the outer end thereof onto which an adjustable end cap 49 may be threaded. The end cap 49 has a multisided cross-section, preferably hexagonal in shape, with a slot 51 formed on its outer end to enable it to be adjusted on the metallic rod 47 by a screw driver or the like. The end cap 49 makes the pushrod 47 adjustable in length and permits it to be locked against change of adjustment when the door bottom 11 is assembled in operating condition. This is effected by the end cap 49 extending into the channel 13 and being of such a size as to be captured within the channel walls and prevented from rotating. In a preferred embodiment, one flat side of the end cap 49 rests against the top of the channel 13 (see also FIG. 6 of U.S. Pat. No. 3,703,788).

To change adjustment of the length of the pushrod 47, the block 37 is released from its connection with the channel 13, and the pushrod and spring assembly 35 is slid out of the channel 13 until the end cap 49 is free thereof and can be turned to effect a new length of the pushrod. The assembly is then reinserted and the first slide block 37 is again secured in position. The end cap 49 is then prevented from turning and changing adjustment.

A drop bar assembly 57 is freely mounted within the lower section 33 of the channel 13 and comprises an extruded H-shaped member 59 holding a flexible sealing element 61. The drop bar 57 is connected to the pushrod and spring assembly 35 by a pivot pin 63 or the like in an upper compartment formed in the drop bar 57. Drop bar 57 has slots 65 formed on each outside edge portion which hold T-shaped sealing strips 67. (See FIGS. 3C and 3D of U.S. Pat. No. 3,703,788). The bottom compartment of the drop bar includes a pair of horizontally inwardly projecting flanges 69 which co-act with slots formed in a reduced size upper portion 71 of the flexible sealing element 61 to hold the sealing element 61 in the drop bar (See FIGS. 5–7). The sealing element 61 is made, for example, from neoprene and which may include a hollow or sponge filled lower portion.

To assemble the door bottom 11, the depressed (central) portion of the leaf spring 41 is placed in the upper compartment of the drop bar 57 and is held therein by the pivot pin 63 or any equivalent fastener to form a single or unitary unit. The blocks 37 and 39 of the pushrod and spring assembly 35 are then slid into the upper section 31 of the U-shaped channel 13 while, at the same time the drop bar assembly 57 attached thereto is slid into the lower section 33. The tapped hole in the block 37 is aligned with a hole formed in one of the legs of the channel 13 and a retaining screw 73 is inserted holding the block 39 and thereby the single unit comprising the pushrod 47, spring 41, and drop bar assemblies 57 in position. In the assembled condition of FIGS. 3–7, the drop bar assembly 57 rests entirely within the lower section 33 of the U-shaped channel 13.

The assembled door bottom 11 may be fixed on a door with the bottom of the channel 13 flush with the bottom of the door, as shown in FIG. 1. Because of the adjustability of the pushrod and spring assembly 35, the channel 13 and drop bar assembly 57 may be reduced in length by a hacksaw as much as six inches to fit a wide range of door widths. Furthermore, the pushrod and spring assembly 35 may be easily inserted from either side of the channel 13 to allow for left hand or right hand installation. This enables one standard size door bottom 11 to be easily cut to fit different bottom gaps, and opening from different directions, right at the job site. In addition, this permits the door bottom 11 to be mass produced from mainly extruded pieces of material, all the channels and the sealing elements, with the only exception being the pushrod and spring assembly 35 which is of extremely simple manufacture, for a wide variety of sizes of doors, thereby effecting great savings in manufacturing costs.

Figure 2:
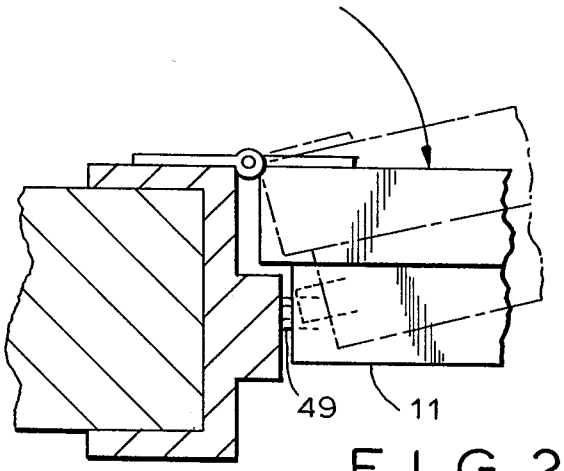
FIG. 2 is a partial top cross sectional view taken along line 2—2 of FIG. 1 showing the extending pushrod of the present invention in two positions, before and after contact with the door frame.

When the weatherstrip is mounted on the door of FIG. 1, a striker plate (not shown) is attached to the door jamb in such a position that upon closing the door, the end cap 49 contacts the plate (See FIG. 2 depicting the action of the end cap 49 upon contact with the door jamb). This causes the end cap 49 to be driven into the channel 13, driving the slide block 39 in the first internal section 31 to the right, as viewed in FIG. 3. The movement of the second slide block 39 causes the leaf spring 41 to be further flexed or dished due to the retaining screw 73 holding the block 37. As the leaf spring 41 is further dished, it is driven further into the second internal section 33 and acts against the drop bar thereby forcing the entire drop bar assembly 57 downwardly, against the frictional force of the sealing strips 67, and partially out of the lower section of the channel until it contacts the door sill. The amount of movement or reciprocation of the drop bar assembly 57, and therefore the pressure of the sealing element 61 against a door sill is, of course, dependent on the space between the bottom of the door and the amount of travel of the sealing element 61. This travel is adjustable up to a maximum of approximately one inch by adjusting the end cap 49 on the pushrod 47.

With the door bottom 4 of the present invention installed on the door as illustrated in FIG. 1, the sealing element 61 will be automatically retracted, as the door is opened, entirely into the channel 13 by the action of the leaf spring 41 unflexing as the pressure against the end cap 49 is removed. The door may therefore be opened more easily, without causing undue wear of the sealing element 61. Moreover, upon closure of the door, the sealing element 61 is forced into contact with the door sill only after the door is completely closed. Therefore, the door bottom may be adjusted to insure maximum travel of the sealing element 61 and thereby more effectively blocking the space between the door and the door sill. In addition, should the door or door sill become misaligned or misshapened, the adjustability feature of the weatherstrip allows the travel of the flexible element to be regulated to conform to the space to be blocked.

In order to make the automatic door bottom of the present invention seal more evenly, and to avoid premature contact of the seal with the adjacent floor or sill as the door closes one or two pair of magnets are used which act to cause one end of the flexible sealing element 61 to drop down into contact with the door sill before the other end thereof. A first pair of magnets 75 and 77 is located near the second slide block 39 and the end cap 49. The first magnet 75 of the pair is attached to the top wall 21 of the channel 13 by a compatable adhesive, or in any other convenient manner. The second magnet 77 of the pair is similarly affixed to the drop bar assembly 57. This first pair of magnets 75 and 77 is oriented such that they repel each other. A second pair of magnets 79 and 81 is located near the first slide block 37. The third magnet 79 is attached to the upper wall 21 of the channel 13 as was the first magnet 75. The fourth magnet 81 is attached to the drop bar assembly 57 as was the second magnet 77. This second pair of magnets is oriented so that they attract each other. Because of the repulsion of the first pair of magnets, the end of the sealing element 61 closest to the end cap 49 is forced out of the channel 13 first. Likewise, the attraction of the second pair of magnets retains the end of the sealing element 61 located near the first sliding block 37 in the channel 13 until after the rest of the sealing element 61 has been forced out of the channel 13. In this manner as the door is closed the portion of the sealing element 61 nearest the hinge side of the door frame drops down first onto the sill. The portion furthest from the inside of the door and which has not yet moved over the sill remains retracted so as not to rub on the adjacent floor or carpeting. It drops down as the door approaches its fully closed position, when that end of the sealing element has moved over the sill. Conversely, when the door is opened this outer end of element 61 retracts first.

Substantially the same function can be achieved by using only one pair repelling of magnets 75, 77 or by eliminating one of the attractive magnets, 79, 81 and substituting a steel plate or the like therefore.

The invention has one other unique and important feature: the door bottom is self leveling due to the unique spring arrangement and its connection with the drop bar assembly. The pivot pin simply interconnects the drop bar with the spring, and as the pushrod forces the spring to flex, it flattens out against the sealing element in the drop bar and the sealing element conforms to the floor.

While the invention has been described in considerable detail, it is not to be limited thereto except as necessitated by the appended claims.

I claim:

1. An automatic door bottom comprising:

(a) an inverted U-shaped channel having facing longitudinal rib members formed internally thereof dividing said channel into upper and lower internal sections, wherein said upper internal section is disposed along the closed portion of said U-shaped channel and said lower internal section is disposed along the open portion of said channel;

(b) a drop bar assembly having first and second ends, wherein said drop bar assembly is disposed within said lower internal section, and wherein said drop bar assembly includes a flexible sealing element;

(c) an adjustable length pushrod assembly mounted within said upper internal section of said channel and releasably held therein by a holding block, said assembly including a pushrod having first and second ends, wherein said second end extends out of one end of said upper section of said channel and wherein said second end is capable of sliding with respect thereto; said pushrod being located in said channel above the second end of said drop bar assembly;

(d) spring means engaged with said first end of said pushrod and interconnected with said drop bar assembly to form a unitary assembly held in said channel by said holding block, said drop bar assembly and said flexible sealing element being forced partially out of said lower internal section of said channel when a force is applied to said second end of said pushrod driving it into said channel to actuate said spring means; and (e) first and second interactive magnet means, wherein said first magnet means is mounted in a fixed position in said upper internal section against movement and adjacent said pushrod and said second magnet means is connected to said drop bar assembly, beneath said first magnet means, said first and second interactive magnet means being of like polarity to repel each other, whereby when a force is applied to said second end of said pushrod to actuate said spring means said second end of said drop bar assembly is forced out of the channel into contact with a door sill before said first end of the drop bar assembly due to the repulsion of said fixed magnet means.

2. A door bottom according to claim 1, wherein said first end of said pushrod is engaged with one end of a flexible leaf spring, and wherein the center portion of said leaf spring projects from said first internal section of said channel member into said second internal section and is interconnected to said drop bar assembly, whereby upon the sliding of said second end of said pushrod into said channel, said leaf spring is flexed so that said flexible sealing element is forced partially out of said channel and into contact with a door sill.

3. A door bottom according to claim 2, further including end cap means for adjusting the length of said pushrod, wherein said end cap is locked against change of adjustment when the door bottom is assembled in operating condition.

4. A door bottom according to claim 3, wherein said end cap extends into said upper internal section of said channel when the door bottom is assembled in operating condition and wherein said end cap is locked against rotation by the sides of said channel, and wherein said end cap comprises a multisided end cap screw threadedly carried by said second end of said pushrod.

5. An automatic door bottom according to claim 1, wherein said holding block is fixed to said spring means and is further fixed in said channel by a screw inserted through said channel.

6. An automatic door bottom according to claim 1, further comprising third and fourth interactive magnet means, wherein said third magnet means is disposed in said upper internal section above said first end of the drop bar assembly and said fourth magnet means is connected to said drop bar assembly adjacent its first end.

7. An automatic door bottom according to claim 6, wherein said third and fourth interactive magnet means attract each other thereby delaying the movement of said first end of said drop bar assembly into contact with the door sill until after said second end of said drop bar assembly has contacted the door sill.

8. An automatic door bottom for sealing the gap between the bottom of a door and its adjacent sill comprising:

(a) an inverted U-shaped channel member for mounting along the bottom of a door, said U-shaped portion having two rib members formed on the interior surface of said channel dividing it into upper and lower internal sections;

(b) a pushrod and spring assembly including first and second slide blocks disposed within said upper internal section, said first block being removably secured in said channel in a predetermined position, said second block being freely mounted within said upper internal section and slidable with respect to said first block, said first and second blocks being connected by a curved leaf spring having its central portion extending into said lower internal section of said channel, and a pushrod connected to said slidable second block projecting away from said leaf spring and out of one end of said channel;

(c) an end cap on said pushrod and extending from said channel;

(d) a drop bar having first and second ends, wherein said drop bar is slidably disposed within said second internal section of said channel and wherein said drop bar has a flexible sealing element attached thereto, said flexible sealing element having first and second ends, means for connecting said drop bar to said leaf spring, said leaf spring being formed to flex when a force is applied against said end cap whereby said end cap is driven into said channel forcing said leaf spring to project further into said lower internal section thereby forcing said flexible sealing element attached to said drop bar partially out of said lower internal section of said channel and into contact with the door sill;

(e) first and second interactive magnet means located near said second block and said second end of said drop bar, wherein said first magnet means is disposed in said upper internal section and said second magnet means is connected to said drop bar and wherein said first and second interactive magnet means repel each other thereby forcing said second end of said drop bar having said flexible sealing element attached thereto into contact with the door sill before said first end of said drop bar.

9. An automatic door bottom for sealing the gap between the bottom of a door and its adjacent sill comprising:

(a) an inverted U-shaped channel member for mounting along the bottom of a door, said U-shaped portion having two rib members formed on the interior surface of said channel dividing it into upper and lower internal sections;

(b) a pushrod and spring assembly including first and second slide blocks disposed within said upper internal section, said first block being removably secured in said channel in a predetermined position, said second block being freely mounted within said upper internal section and slidable with respect to said first block, said first and second blocks being connected by a curved leaf spring having its central portion extending into said lower internal section of said channel, and a pushrod connected to said slidable second block projecting away from said leaf spring and out of one end of said channel;

(c) an end cap on said pushrod and extending from said channel;

(d) a drop bar having first and second ends, wherein said drop bar is slidably disposed within said second internal section of said channel and wherein said drop bar has a flexible sealing element attached thereto, said flexible sealing element having first and second ends, means for connecting said drop bar to said leaf spring, said leaf spring being formed to flex when a force is applied against said end cap whereby said end cap is driven into said channel forcing said leaf spring to project further into said lower internal section thereby forcing said flexible sealing element attached to said drop bar partially out of said lower internal section of said channel and into contact with the door still;

(e) first and second interactive magnet means located near said second block and said second end of said drop bar, wherein said first magnet means is mounted in a fixed position in said upper internal section against movement and said second magnet means is connected to said drop bar and wherein said first and second interactive magnet means repeal each other thereby forcing said second end of said drop bar having said flexible sealing element attached thereto into contact with the door sill before said fist end of said drop bar; and third and fourth interactive magnet means located near said first block and said first end of said drop bar, wherein said third magnet means is mounted in a fixed position in said upper internal section and said fourth magnet means is connected to said drop bar and wherein said third and fourth interactive magnet means attract each other thereby delaying the movement of said first end of said flexible sealing element attached to said drop bar, into contact with the door sill until after said second end of said flexible sealing element has contacted the door sill.

10. A door bottom according to claim 9, including a bearing block mounted in said upper internal section of said channel to guide and position said pushrod.

11. An automatic door bottom comprising:

(a) an inverted U-shaped channel having facing longitudinal rib members formed internally thereof dividing said channel into upper and lower internal sections with said upper internal section disposed along the closed portion of said U-shaped channel and said lower internal section along the open portion of said channel;

(b) a drop bar assembly having first and second ends, said drop bar assembly including a flexible sealing element and having first and second ends, wherein said flexible sealing element is disposed within said lower internal section of said channel;

(c) a pushrod assembly mounted within said upper internal section of said channel, said pushrod having first and second ends, wherein said second end of the push bar is located above the second end of the drop bar and extends out of one end of said upper internal section and is capable of sliding with respect thereto;

(d) an end cap carried by said second end of said pushrod for adjusting the length of said pushrod;

(e) a flexible leaf spring engaged with said first end of said pushrod, the center portion of said leaf spring projecting from said upper internal section of said channel member into said lower internal section where it is interconnected to said drop bar assembly whereby upon movement of said second end of said pushrod into said channel said leaf spring is flexed downwardly to force said flexible sealing element partially out of said channel and into contact with the door sill; and (f) first and second interactive magnet means, wherein said first magnet means is mounted in a fixed position in said upper internal section near said first end of said drop bar and said second magnet means is attached to said drop bar assembly near said first end of said assembly and wherein said first and second magnet means attract each other whereby when a force is applied to said second end of said pushrod to actuate said spring means said second end of said drop bar assembly is forced out of the channel into contact with a door sill before said first end of the drop bar assembly due to the attraction of said magnet means.

12. An automatic door bottom as defined in claim 11 including third and fourth interactive magnet means, wherein said third magnet means is disposed in said upper internal section near said first end of said pushrod and said fourth magnet means is attached to said drop bar assembly near said first end of said drop bar assembly and wherein said third and fourth interactive magnet means attract each other to permit said second end of said flexible sealing member to contact the door sill before the first end of said flexible sealing member.

* * * * *